United States Patent [19]

Fildan

[11] Patent Number: 4,943,026

[45] Date of Patent: Jul. 24, 1990

[54] HANGER FOR SMALL PACKAGES

[76] Inventor: Gerhard Fildan, Leonberger Strasse 86, D-7259 Friolzheim, Fed. Rep. of Germany

[21] Appl. No.: 353,317

[22] Filed: May 17, 1989

[30] Foreign Application Priority Data

May 20, 1988 [DE] Fed. Rep. of Germany ..... 8806612

[51] Int. Cl.[5] ..... A47G 29/00

[52] U.S. Cl. ..... 248/339; 24/561

[58] Field of Search ..... 248/339, 340, 544, 211, 248/213, 214, 215, 301, 304, 305, 306, 307, 308, 316.7, 316.5, 316.6, 341, 690, 691, 692; 211/113; 223/DIG. 4, 88; 24/343, 347, 348, 349, 545, 547, 555, 561, 562

[56] References Cited

U.S. PATENT DOCUMENTS

| | | | |
|---|---|---|---|
| 537,120 | 4/1895 | Lieb | 248/215 |
| 1,342,698 | 6/1920 | Stevens | 24/561 |
| 1,343,855 | 6/1920 | Tyler | 248/215 |
| 2,818,624 | 1/1958 | Fauteux | 248/301 |
| 3,310,272 | 3/1967 | Brunger | 211/113 |
| 3,692,269 | 9/1972 | Hales | 248/339 |
| 3,744,685 | 7/1973 | Hart | 24/561 |
| 3,870,267 | 3/1975 | Okle | 248/339 |
| 4,368,865 | 1/1983 | Kolbe | 248/214 |

FOREIGN PATENT DOCUMENTS

| | | |
|---|---|---|
| 2607581 | 9/1977 | Fed. Rep. of Germany . |
| 2188613 | 10/1987 | United Kingdom . |

*Primary Examiner*—Ramon O. Ramirez
*Assistant Examiner*—Robert A. Olson
*Attorney, Agent, or Firm*—Herbert Dubno

[57] ABSTRACT

A hanger for a package has a frame extending downwardly from a hook and having a lower portion extending beyond a locking finger so as to prevent unnoticeable opening of a cover of a package held by the hanger. The locking finger is inclined to the plane of the frame and the frame has guide surfaces parallel to the locking finger so that the frame will be canted relative to the package to ensure the cover locking positioning of the hanger.

1 Claim, 1 Drawing Sheet

HANGER FOR SMALL PACKAGES

FIELD OF THE INVENTION

My present invention relates to a hanger for small packages and, more particularly, to a suspension device for suspension-display packaging of the type in which a locking finger connected to a hook by which the device can be suspended from a rod, bar or rail, is provided to retain the packaging on the device.

BACKGROUND OF THE INVENTION

A suspension device which can be used for the display of small packages for sale in so-called point of sale displays, or for vending packaged goods generally, is described in the United Kingdom Patent Publication No. 2 188 613. The device there described has a rectangular frame from an upper limb of which a finger is centrally angled to lie parallel to the plane of the frame and this finger is formed with a barb engageable in a hole in the package when the upper edge of the package is inserted between the finger and the frame. Two guide bulges are provided on the vertical limbs of the frame.

Such devices and the device of the invention can be used for suspending boxes, cards and like display packages from a rod, bar or rail so as to display the goods as an incident to purchase.

Many goods, especially textile products, are put up in small boxes for each piece or pair of pieces, with corresponding illustrations and descriptive legends. Such goods may also be put up in transparent packaging so that they can be individually suspended for sale.

For this purpose, holding devices of the type described in the United Kingdom reference can be provided for engagement with an upper part of the package.

However, these earlier systems are not always satisfactory. For example, it is not always easy to guide the package into the hanger or the hanger onto the package so that the barb of the locking finger thereof is reliably fit into a hole of the packaging material. Especially when the package is a box, earlier systems could not adequately ensure the security of the contents.

OBJECTS OF THE INVENTION

It is, therefore, the principal object of the present invention to provide an improved hanger for packages of the aforedescribed type which allows rapid and simple alignment of the barb with a hole in the packaging material so that excessive attention need not be paid to such alignment during insertion of the package in the hanger.

Another object of the invention is to provide a simpler and more easily manipulated hanger.

Still another object is to provide a hanger which overcomes drawbacks of earlier systems.

Yet another object of my invention is to provide a hanger which more reliably will hold a package and which can also provide security for the contents thereof.

SUMMARY OF THE INVENTION

These objects and others which will become apparent hereinafter are attained, in accordance with the present invention in a hanger which comprises a hook, a frame extending downwardly from a bottom portion of the hook and a locking finger which is affixed with the frame to the bottom portion of the hook and preferably molded unitarily with the hanger and the frame. According to the present invention, the locking finger has a rest position in which it is inclined away from the frame and to the latter in a direction away from the hook so that it lies at a slight angle to the plane of the frame. According to the invention, moreover, the frame has a pair of mutually parallel limbs extending downwardly from the hook and formed with triangular guide members which are provided with a linear inlet ramp, guiding the package past the apex of the respect guides, and a guide surface running from the apex to the plane of the frame which lies parallel to the locking finger in its rest position. The locking finger is provided with a barb at the level of the apexes of the guide portions of the frame, i.e. so that a line connecting these apexes passes through the barb on the inner face of the locking finger.

The lower part of the frame is formed as a safety stirrup which extends downwardly beyond the end of the locking finger to a location at which it can prevent an opening of a package screwed in the hanger and having a cover which is prevented from opening by the presence of this stirrup. The guide surfaces cooperate with the finger and the extended stirrup to hold the hanger at an inclination to the wall of the box inserted in the hanger, whereby the stirrup can provide security against opening of the cover.

A double film hinge can be provided between the frame and the hook to allow a buckling of the frame relative to the hook and adjacent of the hanger to the position of the freely suspended package in a particularly convenient manner.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 3:
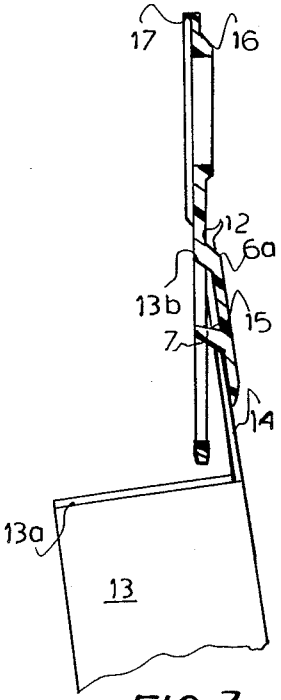
FIG. 3 is a section taken along the line III—III of FIG. 1, but illustrated with a package in place.
Figure 2:
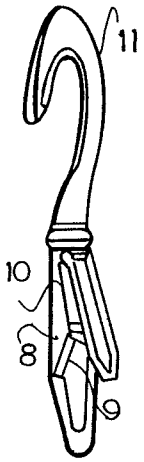
FIG. 2 is a perspective view of the hanger of FIG. 1.
Figure 1:
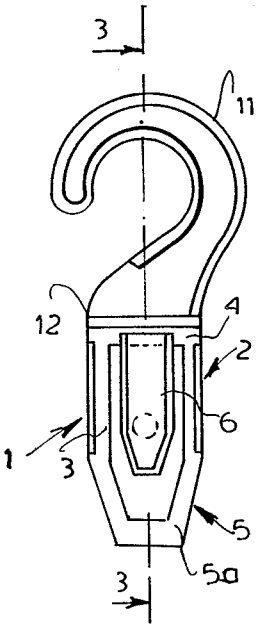
FIG. 1 is an elevational view of a hanger according to the present invention.

The hanger 1 shown in FIGS. 1 through 3 comprises a frame 2 molded unitarily with a hook 11 at the bottom of the latter. The hook 11 can have a bead 16 projecting from one side around at least a portion of its opening and a bead 17 projecting from its opposite side along its outer periphery 6 for stiffening purposes.

The frame 2 comprises two vertical limbs 3 and a lower portion 5 having a trapezoidal configuration and constituting a stirrup. The upper limb 4 of the frame is connected to the hook 11 by a double film hinge 12 formed when the entire hanger is molded unitarily from a plastic, especially a thermoplastic.

At the front side of the upper limb 4 of the frame, a locking finger 6 is formed and is angled downwardly and outwardly away from the plane of the frame and close to its lower end is provided with an inwardly projecting barb 7. This angled portion of the locking finger 6 has been represented at *6a*.

The slight angle between the locking finger 6 and the plane of the frame 2, best seen in FIGS. 2 and 3 can be between 5° and 10°.

On the front side of the limbs 3 of the frame, guide portions 8 project forwardly. The guide portions 8, as can be seen from the side (see especially FIGS. 2 and 3), are triangular and a line through the apexes of the formations extends through the barb 7. Each of these formations 8 has an inlet guide ramp 9 over which the leading edge **13*b* of the cardboard wall 14 of a package can be guided into the space between the locking finger and the frame. Each projection 8 also has a guide surface 10. The angle made by the guide surfaces 10 to the plane of the frame 2 corresponds to that between the locking finger 6 and this plane so that the locking finger 6 is parallel to the guide surfaces 10**.

The lower portion 5 of the frame is constituted as a safety stirrup and is defined by a pair of downwardly converging (upwardly diverging) shanks **5*a* connecting this stirrup to the side members 3 of the frame. The length of this stirrup 5** is selected so that it can perform the security function described below.

To mount the hanger 1 on a box 13 to be suspended therefrom (FIG. 3) the leading edge **13*b* of the upwardly extending cardboard wall 14 of the box 13 is fitted between the frame 2 and the locking finger 6 so that this leading edge is guided upwardly by the ramps 9. During the insertion, because of the elasticity of the locking finger 6, the barb 7 springs into the hole 15 in the cardboard wall 14. To prevent the projection 7 from springing out of the hole 15, the projection 7** has a barb shape, i.e. an inclination of the projection which is upwardly and inwardly relative to the frame and the finger.

Once the cardboard wall 14 is retained as shown in FIG. 3 and comes to rest upon the guide surfaces 10, it is locked in place by the barb 7. Because of the angle between the guide surfaces 10 and the plane of the frame, the stirrup 5 is tilted inwardly of the cardboard portion 14 and is located immediately above the cover 13 of the package so that unauthorized opening of the cover **13*a* is prevented as long as the hanger is in place. The doubled film hinge 12 allows the package to hang freely inspite of the orientation of the hook 11 on its hanging rod because of the free mobility provided by the hinge about the horizontal axis. To release the package from the holder 1, it is only necessary to pull the finger 6 forwardly and free the barb 7** from the package.

I claim:

1. A holder for suspending a package comprising:

a hook;

a frame formed on a lower portion of said hook and having an upper frame member and a lower frame portion and a pair of side member connecting said upper frame member and said lower frame portion, said frame lying in a plane;

a locking finger extending downwardly from said upper frame portion and inclined downwardly and outwardly away from said plane of said frame at a front side of said frame in a rest position, said locking finger being formed with an inwardly and upwardly extending barb engageable in said package, said side members each being formed with a guide formation of triangular configuration defining a linear inlet ramp for guiding an edge of said package between said frame and said finger, an apex substantially at a level with said barb, and a linear guide surface extending from said apex toward said plane, said guide surfaces being parallel to said finger in said rest position thereof, said lower portion of said frame forming a security stirrup overlying a cover of said box and preventing unauthorized opening thereof as long as said box is retained in said hanger; and a double film hinge formed by two closely spaced horizontal film hinges between said upper frame member and said hook, said hook, said frame and said finger are all molded unitarily of a synthetic resin material.

* * * * *